US005135147A

United States Patent [19]

Granger

[11] Patent Number: 5,135,147

[45] Date of Patent: Aug. 4, 1992

[54] DISPENSER FOR CUTTING WIPING MATERIALS STORED IN A UNIT AND DISPENSES A NARROW, CONCERTINA TYPE FOLDED STRIP

[76] Inventor: Maurice Granger, 17 rue Marcel Pagnol, 42270 Saint Priest En Jarez, France

[21] Appl. No.: 487,197

[22] Filed: Mar. 1, 1990

[30] Foreign Application Priority Data

Mar. 3, 1989 [FR] France ..... 89 03416

[51] Int. Cl.[5] ..... B26D 5/26

[52] U.S. Cl. ..... 225/96; 225/106; 83/334

[58] Field of Search ..... 225/96, 106; 83/334, 83/335

[56] References Cited

U.S. PATENT DOCUMENTS

| | | | |
|---|---|---|---|
| 2,560,061 | 7/1951 | Agamaite, Jr. | 83/334 |
| 2,873,965 | 2/1959 | Mitchell | 270/40 |
| 3,835,745 | 9/1974 | Basu et al. | 83/285 |
| 4,621,755 | 11/1986 | Granger | 225/96 |
| 5,013,291 | 5/1991 | Granger | 493/357 |

FOREIGN PATENT DOCUMENTS 2084626 4/1982 United Kingdom .

*Primary Examiner*—Frank T. Yost
*Assistant Examiner*—John M. Husar
*Attorney, Agent, or Firm*—Eric P. Schellin

[57] ABSTRACT

The device for cutting wiping materials stored in a unit which automatically dispenses them in the form of a narrow, concertina-folded strip is outstanding in that it is made up of two profiled, metal blades with a cutting edge (5 and 6) mounted, so as to elastically hinge, between two pairs (1–2) and (3–4) to feed the folded material, at a determined point so that when the said pairs are rotated, the blades are gradually superimposed from one end to the other, during the rotation whilst remaining in permanent contact and in a position substantially parallel to the rotation axes of the pairs of toothed wheels throughout the cut in order to provide shearing type cutting of the folded strip of material inserted between the said pairs and fed by manually pulling the strip projecting from the unit causing the pairs to rotate.

3 Claims, 3 Drawing Sheets

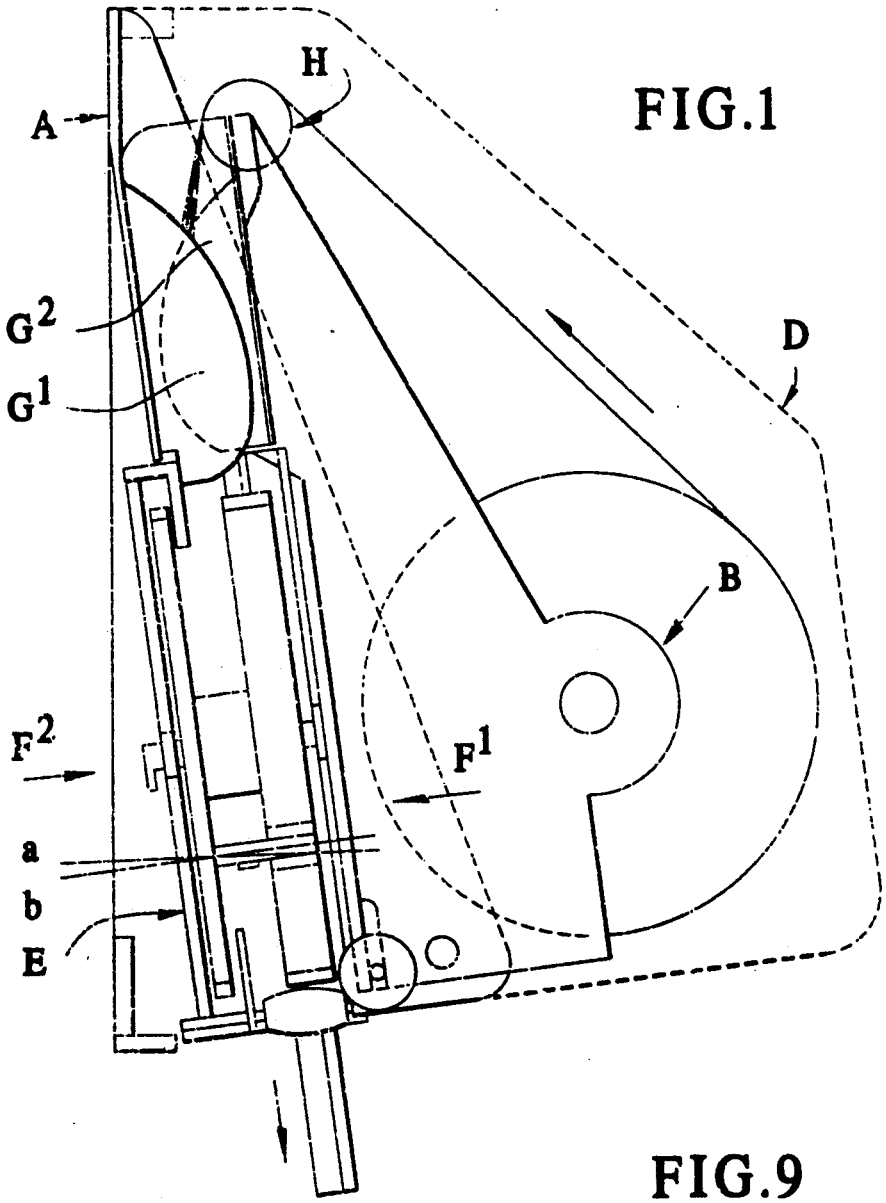
FIG.1
FIG.9
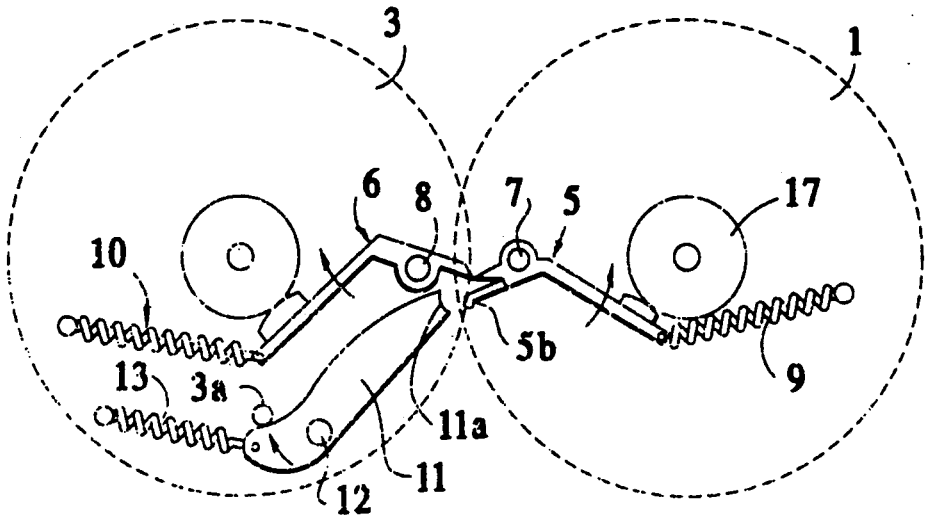

DISPENSER FOR CUTTING WIPING MATERIALS STORED IN A UNIT AND DISPENSES A NARROW, CONCERTINA TYPE FOLDED STRIP

BACKGROUND OF THE INVENTION

1. Field of the Invention

Device for cutting wiping materials stored in a unit which automatically dispenses them in the form of a narrow, concertina-type folded strip. The invention relates to a cutting device for wiping materials stored in a unit which automatically dispenses them in the form of a narrow, concertina-type folded strip.

The invention relates to the technical sector for units to dispense wiping materials of the paper, cotton wool, non-woven or other types.

2. Description of the Prior Art

Many units and devices designed to either automatically or non-automatically dispense lengths of wiping materials in public or private toilets are known.

These means use various materials: paper, cotton wool, non-woven, which are provided with a certain capacity of absorption. Due to mainly economic reasons, the materials used are thinner and thinner and therefore more fragile.

When it is desired to offer the user a unit capable of automatically dispensing determined lengths of these types of materials by simple pulling on the part projecting from the unit, as is the case for the units protected by patents and the applicant of which is also the holder, it is understandable that, due to the tensile strength, however low it may be, and due to the fact that the user has wet hands, with some very fragile materials, the pulled strip may tear before the end of the dispensing operation.

In order to overcome this disadvantage, the applicant has offered, according to the French patent application Nos. 88.05939 and 88.07823 both the priority documents for issued U.S. Pat. No. 5,013,291, a unit capable of cutting and automatically dispensing lengths of wiping materials, even the thinnest types, without there being the risk of undue tearing. With this in mind, means combined between one another, have been provided to successively fold the unrolled strip in concertina form, feed it and cut it to length automatically, when the folded end, projecting from the unit is pulled, thereby having a strong, narrow strip in the hand which unfolds itself naturally and offers sufficient wiping surface.

With this type of unit, the feeding and cutting device for the folded strip mounted onto a fixed part or in the interchangeable cassette, is quite suited for the problem brought up. However, according to the type of wiping material used, the cut by penetration and tearing obtained by a pinked blade and the gripping action of two support and counter support jaws, can be modified, i.e. the folded strip can be cut too early and then the following strip may not project from the unit, or too late which may lead to too much projecting from the unit and more pulling force being required.

In order to obtain clean, precise separation of the folded strip when pulling the part projecting from the unit, with all types of wiping materials, from the most fragile to the strongest, with wet hands and despite the direction it comes out of the unit, the cutting device according to the invention has been designed. This is arranged between the pairs of toothed wheels to feed the folded material upstream by complementary projections orientated and spaced as defined in the French patent application No. 88.05939.

SUMMARY OF THE INVENTION

According to a first characteristic, the cutting device is made up of two metal, profiled blades with a cutting edge, mounted so as to be elastically hinged between the pairs of toothed wheels to feed the folded material, at a determined point, so that when the said pairs are rotated, the blades are gradually superimposed from one end to the other during the rotation, whilst remaining in permanent contact under pressure and in a position substantially parallel to the rotation axes of the pairs of toothed wheels throughout the cutting operation in order to provide shearing type cutting of the folded strip of material introduced between the said pairs and fed by manual pulling of the strip projecting from the unit causing the pairs to rotate.

According to another characteristic, the metal blades are kept in permanent contact and in a position substantially parallel to the rotation axes of the pairs of toothed wheels, by a device comprising a connecting rod, elastically hinged with respect to one of the pairs of toothed wheels at the bottom part and formed at the top end so that, when the blades are opposite one another, a projection formed under the metal blade integral to the other pair of toothed wheels, is applied against this profiled end and causes, both the said connecting rod to tip and the said blade to swivel thereby forcing the other blade situated above, to swivel too.

Another characteristic is found in the fact that the hinged connecting rod is positioned in a precise manner on the pair of toothed and profiled wheels at the top end, so that it is in contact with the projection of the thrust blade throughout the fraction of rotation corresponding to the full superimposition of the blades from one end to the other of their cutting edge, and escapes from the said projection during the rest of the rotation.

According to other characteristics, the blades have cutting edges opposite one another, and curves along the length of the blades to enable progressive shearing and their pivoting axes are slightly sloped in an reverse manner in the transversal direction to provide contact between one another.

DESCRIPTION OF THE SEVERAL FIGURES OF THE DRAWING

These characteristics and other shall be made apparent again from the following description.

In order to clarify the object of the invention, however without limiting it, the accompanying drawings have been provided, in which:

FIG. 1 is a schematic view illustrating a unit to dispense wiping material integrating the cutting device according to the invention and the guide and feed means of the material mounted in an interchangeable cassette.

FIGS. 7 and 8 are schematic front and top views illustrating the cutting device at the end of the cut of the folded and pulled strip.

FIG. 9 is a schematic front view illustrating the cutting device immediately after the folded and pulled strip has been cut.

The object of the invention will become more apparent from the following non limitating description when considered in conjunction with the accompanying drawings.

DETAILED DESCRIPTION OF A PREFERRED EMBODIMENT

With reference to FIG. 1, the main components of the unit illustrated shall be reminded successively, considering that the device according to the invention can be combined with other types of units.

The unit is mainly made up of a support (A) to be fixed with respect to any surface, a roll holder (B), a casing (D) and an interchangeable cassette (E), all holding the mechanisms required to feed and cut the strips previously folded in concertina form by projections (G1-G2) made in a complementary manner on the support (A) and on the roll holder (B) which also holds a return and shaping means (H) for the unrolled strip.

The cassette (E) has, in a lateral manner, guide grooves (E1) to slide in slideways on the walls of the support (A) where it is locked automatically and released by manual action.

There are two pairs of coaxial toothed wheels (1-2) and (3-4) mounted, so as to be freely hinged, between the front and rear faces of the cassette. These are provided to guide and feed the folded strip upstream and pass between the two pairs. At the rear, the toothed guide wheels (1-3) with a full set of teeth have a module which is smaller than the toothed drive wheels(2-4). In this way, the toothed guide wheels mesh together without backlash, whereas the toothed drive wheels mesh together with constant backlash enabling the folded strip to pass without jamming.

On the other hand, the outside of the toothed drive wheels have a rounded edge which facilitates the insertion of the strip when loading the unit, whereas the inside of the teeth have a preferably rough surface, especially either side of the notches (2*a*-4*a*) for the cutting device to pass, in order to provide feed after the separated strip has been cut without slipping.

In order to precisely adjust the space between the toothed wheels (2-4) in function of the thickness of the material to be dispensed, an adjustable fixture has been provided for at least one of the pairs of toothed wheels at its rotation axis. This adjustment can be obtained by an means such as tipping according to several positions of the said pair with respect to the faces of the cassette, mounting the pin in a slot, or even using cassettes with pairs of toothed wheels with different spacing.

Figure 2:
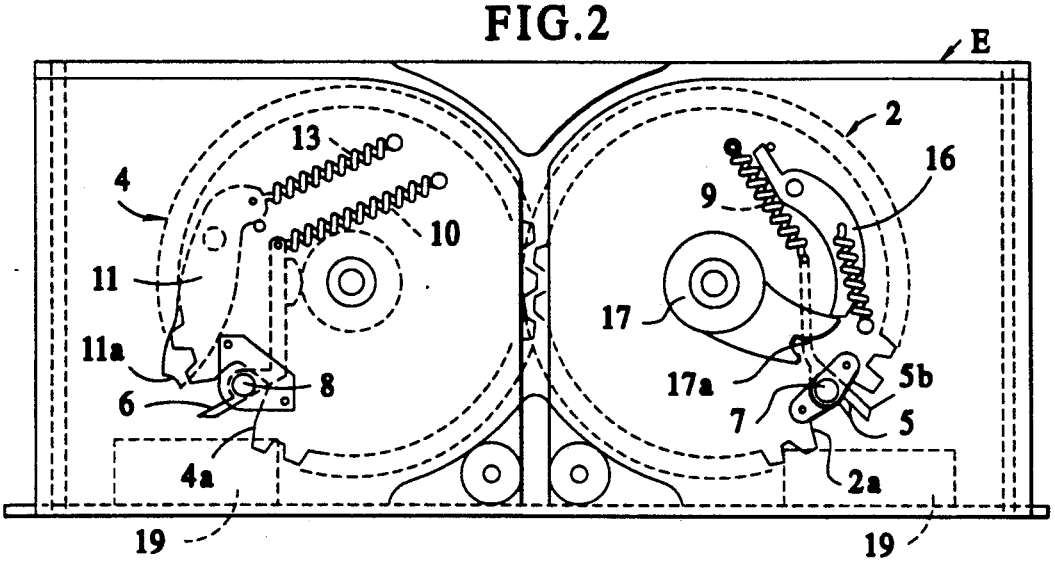
FIG. 2 is a front view according to arrow (F1) of FIG. 1 of the cassette illustrating the cutting device in the idle position.
Figure 3:
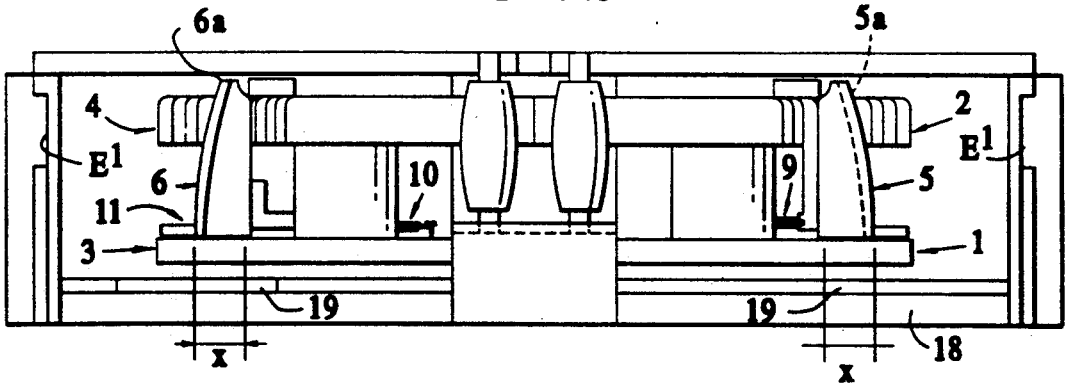
FIG. 3 is a bottom view of the cassette according to FIG. 2.

The cutting device according to the invention is made up of two metal blades (5 and 6) hinged in (7 and 8) with two toothed wheels for each pair and crossing the notches (2*a*-4*a*) of the wheels (2-4). The cutting edge (5*a*-6*a*) of each blade is in the form of reversed bevels and the cutting edge is curved as shown in FIG. 3, i.e. the distance (x) from the cutting edge to the pivoting axis of each blade progressively decreases from the hinged end on the toothed wheels (1-3) to the other end.

It is to be noted that the pivoting axes (a and b) of the blades (5 and 6) are slightly sloped in a reverse manner in the transversal direction for the reasons explained in the rest of the description.

The blades are positioned between the toothed wheels of each pair so that when rotated, the said pairs can be situated opposite one another and slightly offset with their cutting edges superimposed.

Blade (5) is linked, at the end opposite the cutting to the toothed wheel (2) by a spring (9) orientated so as to return the said blade in the direction of rotation of the toothed wheels, in the same way, the blade (6) is returned by a spring (10) and the two blades are applied, when idle, against the hub between the toothed wheels (3-4).

A connecting rod (11) is hinged in (12) close to the bottom end on the toothed wheel (3) underneath the blade (6) in the idle position. The top end situated immediately under the blade, forms a recess (11*a*) to cooperate with a convex projection (5*b*) of the blade (5) when the two blades are opposite one another.

A spring (13) suitably attached to the bottom end of the connecting rod and on the toothed wheel (3), elastically returns the connecting rod to abutt against a stop point (3*a*) of the said toothed wheel.

The operation of the unit fitted with the cutting device according to the invention shall now be described.

When loading the unit, the strip of material is unrolled from the roll mounted on its support (B), then positioned on the return and shaping component (H) and inserted behind the support (B) cleared from the fixed part (A) until its free end projects from the bottom part of the unit.

Figure 4:
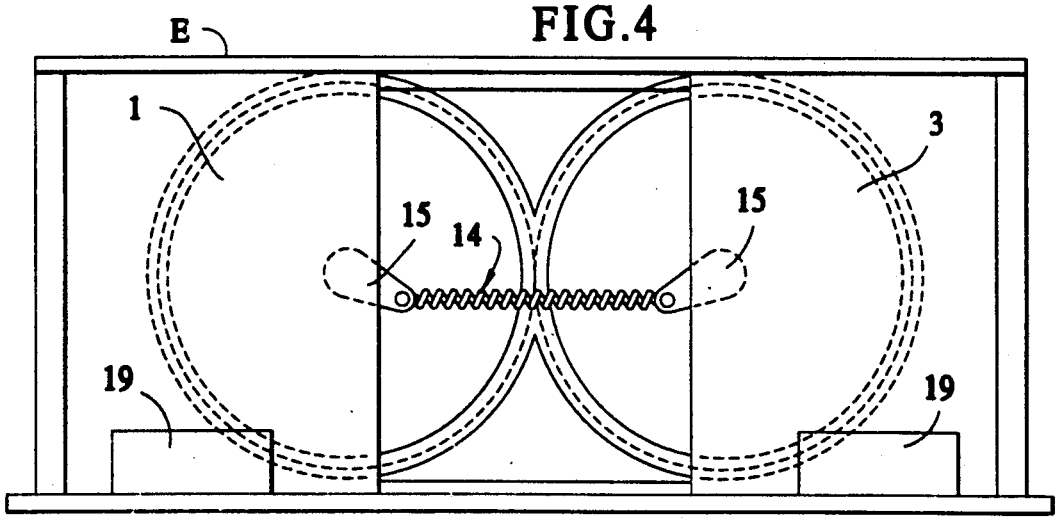
FIG. 4 is a front view according to arrow (F2) of FIG. 1, showing the starting mechanism for the pairs of toothed wheels.

The support (B) is then applied against the fixed part (A) thus starting the folding of the strip by the projections (G1-G2). When the projecting end is pulled, the folded strip automatically goes between the pairs of toothed wheels (1-3) and (2-4) which are then rotated, thereby pulling the spring (14) attached to the ends of eccentrics (15) formed at the end of the rotation axes of the pairs of toothed wheels and outside of wheels (1 and 3). The spring (14) is pre-tensioned in the idle position (FIG. 4) and the eccentrics (15) are orientated so that the spring is in the elastic return phase when the two cutting blades are opposite one another. In this way, the energy stored by the spring is released to be added to the manual pulling force in order to overcome the resistance created by the cutting operation of the material.

Figure 5:
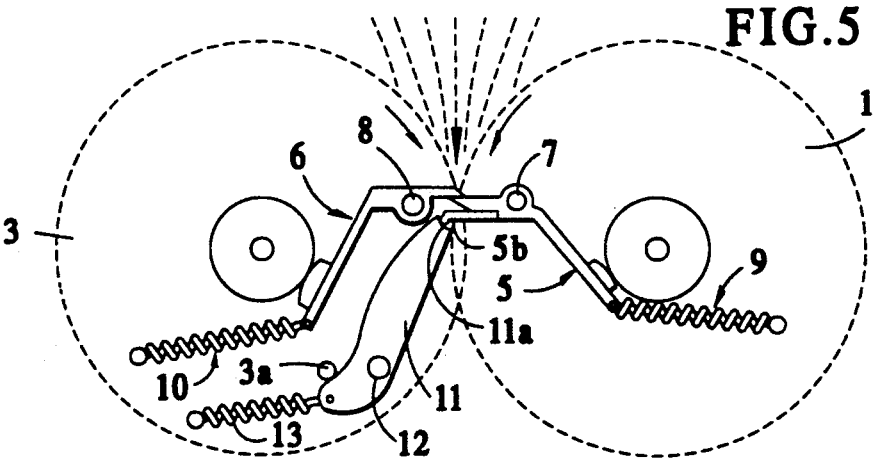
FIGS. 5 and 6 are schematic front and top views illustrating the cutting device at the beginning of the cut of the folded and pulled strip.
Figure 6:
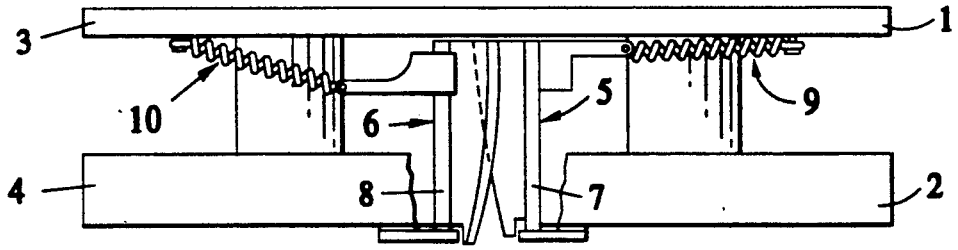

When the two blades are opposite one another (FIGS. 5 and 6), taking their assembly on the toothed wheels into consideration, their active part is substantially parallel to the line passing through the rotation axes of the toothed wheels and the cutting edge of the blade (6) is in contact or nearly in contact with the cutting edge of the blade (5) thereby being ready to be superimposed at their end, situated the toothed wheels (1 and 3) end.

At this moment, the projection (5*b*) of the blade (5) is applied against the recess (11*a*) of the connecting rod (11) which, due to its judiciously calculated hinge point (12), swivels opposite its spring (13) urged by the blade (5) rotated by the manual pulling of the projecting strip. The said blade (5), abutted against its projection (5*b*), stays aligned with the line of axes and supports the blade (6) also driven, the spring of the blade (5) is calibrated to provide the pressure on the blade (6) during the cut.

Figure 7:
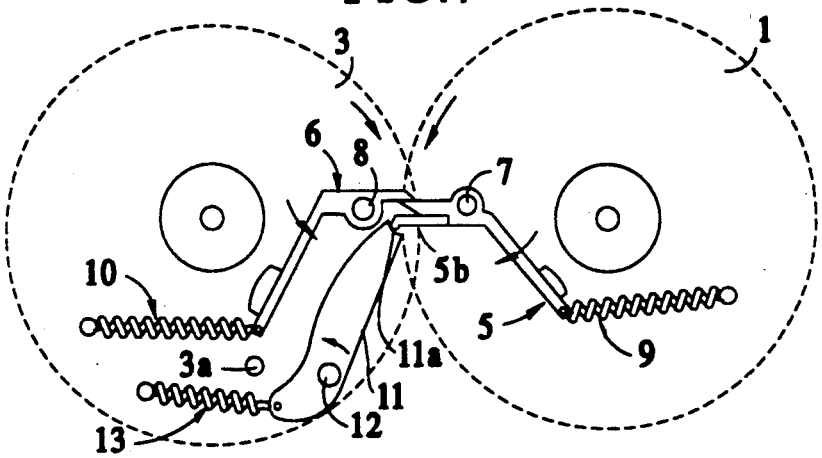
Figure 6:
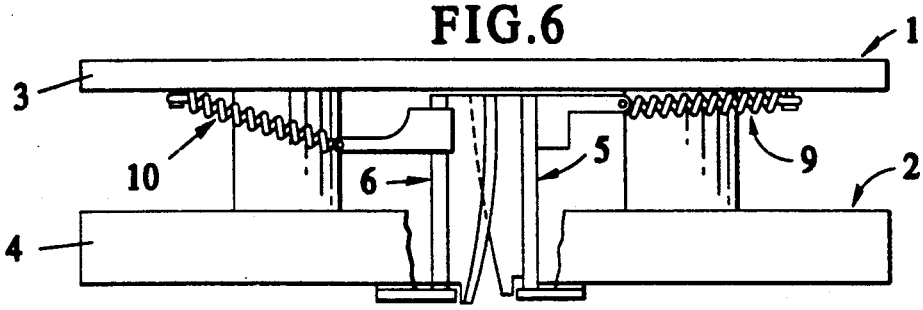

During this phase, the folded strip of material pulled manually, is gradually cut from one edge to the other (FIGS. 7 and 8) due to the curved profile of the cutting edges of the blades.

In practice, the adjustments and configuration of the blades is such that after the cut, a certain thickness of uncut material remains, so that under the manual pulling action, the following strip is also fed between the toothed wheels in order to project from the unit. The complete separation then takes place quite naturally by reaction at the end of the pulling operation when the toothed wheels also driven by the return of the spring (14), go back to their idle position after a pawl (16) elastically hinged on the toothed wheel (2), has passed a projection (17) formed on the hub of the toothed wheel and provided with at least one retainer notch (17*a*) preventing the toothed wheels from turning backwards.

It is to be noted that when the pulled strip is cut, the blades (5 and 6) are substantially on the line of the rotation axes of the toothed wheels At this moment, the recess (11*a*) of the connecting rod (11) escapes from the projection (5*b*) of the blade (5) which can then swivel under elastic return to go back to the idle position, whereas the blade (6) which is no longer supported, carries out the same movement (FIG. 9). The connecting rod (11) also returns to the position abutted against the stop point (3*a*). The unit is then ready to accept another manual pull on the next projecting strip. It is also to be noted that a recess (18) is provided at the rear of the cassette to possibly collect scraps of wiping material which can then be discharged through openings (19).

The advantages are made clearly apparent from the description, the clean precise cut of all types of wiping materials by profiled cutting blades acting by progressive shearing is to be highlighted.

I claim:

1. A cutting device cassette for manually dispensing therethrough discrete elongated longitudinally folded web material comprising a first pair of axially spaced rollers mounted on a first axle said first pair of rollers consisting of a first gear and a first toothed cog wheel, a second pair of axially spaced rollers mounted on a second axle, said second pair of rollers consisting of a second gear and a second toothed cog wheel, said first gears disposed to rotatably mesh and said first toothed cog wheel and said second toothed cog wheel disposed to rotatably mesh and spaced whereby said longitudinally folded web material passes therebetween, a radially disposed recess disposed in each of said toothed cog wheels a blade cutting means mounted in each of said recesses having a cutting edge disposed outwardly radially whereby said cutting edges cut said folded web material into discrete portions when said folded web material passes between said first and second toothed cog wheels and said cutting edges of said blade cutting means are in scissor confrontation as said first pair and said second pair of rollers rotate under the aegis of the folded web material when it is manually pulled to dispense, at least one of said blade cutting means is resiliently mounted, control means gradually superimposing the blades from one end to the other, during rotation of said first pair and second pair of rollers while remaining in cutting contact and in a position substantially parallel to the rotation axes of the first and second pairs of rollers throughout the cutting operation, said control means including a lever mounted resiliently and movable arcuately on said first gear and disposed whereby one end is in transitory abutment with projection means on said second gear.

2. The device of claim 1 wherein the cutting blades are positioned and shaped whereby the cutting takes place on all the folds of the manually pulled web material except a relatively small portion thereof and the web material is separated naturally at the end of the pulling operation by reaction due to the pressure of the first pair of rollers and second pair of rollers on a non-return stop in order to enable the next strip to project automatically.

3. The device of claim 2 wherein the cogs of the first and second cog wheels have a rough surface.

* * * * *